United States Patent [19]

Hogan

[11] 4,315,718

[45] Feb. 16, 1982

[54] PERISTALTIC PUMP AND BEARING ARRANGEMENT THEREFOR

[75] Inventor: Lawrence R. Hogan, Lake Ville, Ill.

[73] Assignee: Cole-Parmer Instrument Company, Chicago, Ill.

[21] Appl. No.: 76,387

[22] Filed: Sep. 17, 1979

[51] Int. Cl.[3] ..... F04B 43/12; F04B 45/08

[52] U.S. Cl. ..... 417/477

[58] Field of Search ..... 417/474, 476, 477

[56] References Cited

U.S. PATENT DOCUMENTS

| | | | |
|---|---|---|---|
| 909,135 | 1/1909 | Behn | 417/476 |
| 2,789,514 | 4/1957 | Hill | 417/476 |
| 2,899,906 | 8/1959 | Becher | 417/477 |
| 2,925,045 | 2/1960 | Mascaro | 417/477 |
| 2,982,225 | 5/1961 | Thompson | 417/477 |
| 3,067,692 | 12/1962 | Brkich | 417/477 |
| 3,249,059 | 5/1966 | Renn | 417/477 |
| 3,358,609 | 12/1967 | Worth et al. | 417/477 |
| 3,408,946 | 11/1968 | McMillan | 417/477 |
| 3,622,252 | 11/1971 | Pickup | 417/477 |
| 3,756,752 | 9/1973 | Stenner | 417/477 |
| 4,070,725 | 1/1978 | Austin | 417/477 |
| 4,113,409 | 9/1978 | Rossmanith | 417/477 |
| 4,211,519 | 7/1980 | Hogan | 417/477 |

FOREIGN PATENT DOCUMENTS

| | | | |
|---|---|---|---|
| 2811093 | 9/1978 | Fed. Rep. of Germany | 417/477 |
| 2383333 | 10/1978 | France | 417/477 |

*Primary Examiner*—William L. Freeh

*Attorney, Agent, or Firm*—Fitch, Even, Tabin, Flannery & Welsh

[57] ABSTRACT

A peristaltic pump having a nonmetallic housing supporting an internal rotor which carries compression rollers for cooperation with a compressible flow tube looped internally of the housing so as to effect a peristaltic pumping action on the tube during rotation of the rotor. The rotor is of unitary construction and is made from a nonmetallic material. The rotor contains hub projections which are directly journaled within bearing surfaces formed within the housing, and rotatably suports at least one nonmetallic compression roller through a tubular open ended metal support shaft which enables air flow through the support tube to provide improved heat transfer during operation.

7 Claims, 3 Drawing Figures

PERISTALTIC PUMP AND BEARING ARRANGEMENT THEREFOR

The present invention relates generally to peristaltic type pumps, and more particularly to a peristaltic pump which includes a nonmetallic housing supporting a nonmetallic internal rotor having rotor hubs directly journaled within bearing surfaces in the housing so as to eliminate anti-friction bearings, and wherein the rotor supports at least one rotatable nonmetallic compression roller through a tubular open ended support shaft which enables fluid flow therethrough to provide improved heat transfer and eliminate anti-friction support bearings for the compression roller as have heretofore been employed.

Fluid pumps of the peristaltic type which operate to provide a moving region or regions of compression along the length of a compressible fluid conduit or flow tube are generally known. Movement of a compressed region along the length of the flow tube forces fluid ahead of the moving region, and the action of the tube in returning to its uncompressed condition creates a partial vacuum which effects forward flow of fluid from the region behind the compressed tube region. See, for example, U.S. Pat. No. 3,358,609, dated Dec. 19, 1967.

It is conventional in known peristaltic pumps to employ an internal rotor which generally carries a plurality of compression rollers for cooperation with the compressible flow tube to effect a peristaltic pumping action thereon. It has also been conventional to support the rotors within the pump housings through anti-friction bearings. Similarly, it has been the practice to rotatably support the compression rollers on the rotor through anti-friction bearings in a manner similar to the construction disclosed in the aforementioned U.S. Pat. No. 3,358,609. As used herein, the term anti-friction bearings refers to metallic ball, roller and needle bearings employing inner and outer metallic races.

While the employment of anti-friction bearings to support both the internal rotor on the housing and the compression rollers on the rotor has resulted in generally successful operation and performance, the anti-friction bearings appreciably limit the use of the corresponding peristaltic pumps in environments where the anti-friction bearings are subject to chemical attack and corrosion as may shorten the useful life of the pumps. In addition, the use of anti-friction bearings to support the rotor and the compression rollers forms a significant factor in the overall pump cost.

One of the primary objects of the present invention is to provide a peristaltic pump which is relatively simple in construction and economical to manufacture.

Another object of the present invention is to provide a peristaltic pump having components which provide improved resistance to chemical attack and thereby provide greater latitude in application than has heretofore been available.

A more particular object of the present invention is to provide a peristaltic pump employing a nonmetallic housing and an internal nonmetallic rotor having rotor hubs which are directly journaled within bearings surfaces in the housing so as to eliminate anti-friction bearingas as have heretofore been employed.

Still another object of the present invention is to provide a peristaltic pump having an internal rotor which carries a plurality of nonmetallic compression rollers each of which is rotatably supported on an open ended tubular support shaft secured to and between annular flanges of the rotor so as to enable passage of fluid such as air through the support shafts for effecting improved heat transfer during operation.

Further objects and advantages of the present invention, together with the organization and manner of operation thereof, will become apparent from the following detailed description of the invention when taken in conjunction with the accompanying drawings wherein like reference numerals designate like elements throughout the several views, and wherein.

Figure 1:
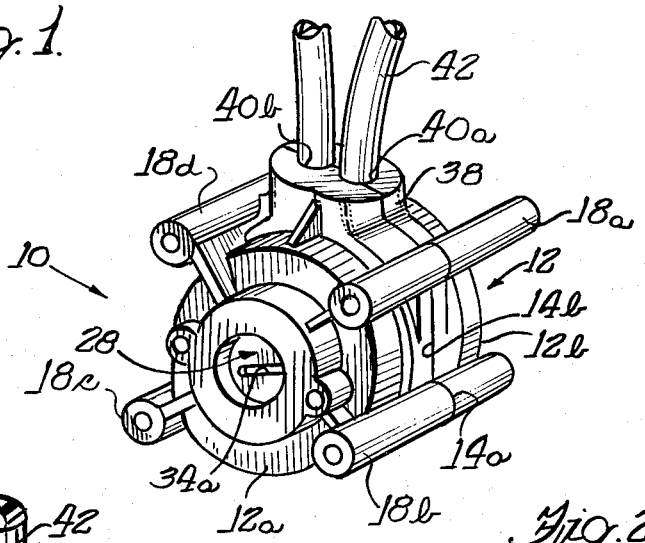
FIG. 1 is a perspective view of a peristaltic pump constructed in accordance with the present invention.

Referring now to the drawing, a peristaltic pump constructed in accordance with the present invention is indicated generally at 10. The peristaltic pump 10 includes a housing, indicated generally at 12, having a pair of substantially identical or symmetrically shaped housing sections or halves 12*a* and 12*b* which, when in assembled relation, have mutually facing and abutting planar surfaces 14*a* and 14*b*, respectively, defining a parting plane transverse to the longitudinal axis of the pump housing as established by a common longitudinal axis of cylindrical bores or openings 16*a* and 16*b* formed in the housing sections 12*a* and 12*b*, respectively.

Figure 2:
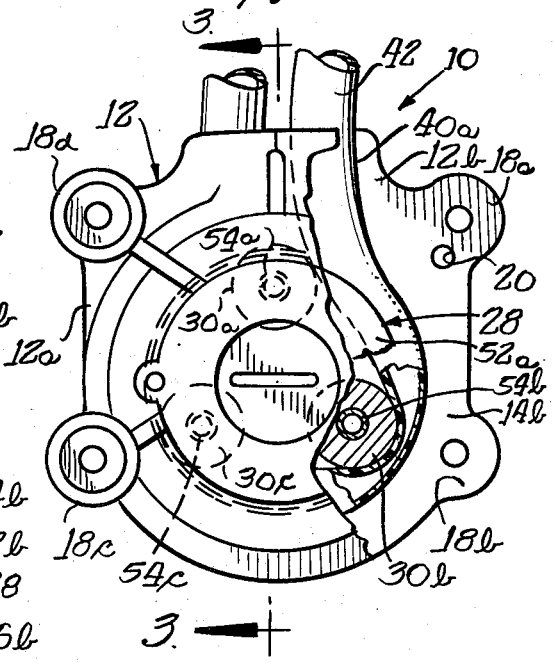
FIG. 2 is a front elevational view, on an enlarged scale, of the peristaltic pump of FIG. 1, portions being broken away for clarity.

In the illustrated embodiment, the housing 12 is made of a suitable plastic material, such as a transparent polycarbonate or an acrylic resin, and, when the housing sections 12*a* and 12*b* are in assembled relation, has longitudinally extending mounting sleeves 18*a, b, c* and *d* adapted to receive mounting screws (not shown) therethrough for maintaining the housing sections in assembled relation and enabling mounting of the pump on a drive motor or the like such as disclosed in copending application Ser. No. 828,482 filed Aug. 29, 1977, which is incorporated herein by reference for that purpose. To facilitate assembly of the housing sections 12*a* and 12*b* in predetermined relation as illustrated in FIG. 1, the housing sections may have mutually cooperable bores and locating pins, one such bore being indicated at 20 in the housing section 12*b* illustrated in FIG. 2 for receiving a complimentary locating pin (not shown) formed on the housing section 12*a*.

When in assembled relation, the housing sections 12*a* and 12*b* define an internal chamber 24 which is intersected by and has its longitudinal axis coincident with the axis of bores 16*a* and 16*b*. The housing 12 rotatably supports a rotor, indicated generally at 28, within the chamber 24 for rotation about the longitudinal axis of the pump housing. The rotor 28 carries a plurality of compression rollers which, in the illustrated embodiment, comprise three cylindrical compression rollers 30*a*, 30*b* and 30*c*. The rotor 28 has planar end surfaces 32*a* and 32*b* each of which has a central generally rectangular slot 34*a*, 34*b*, respectively, formed therein for receiving a drive key to operatively connect the rotor to the drive shaft of a drive motor for selectively rotating the rotor 28 as is known. It will be understood that the rotor 28 may be adapted for coupling to drive means through any suitable coupling arrangement.

When in assembled relation, the housing sections 12*a* and 12*b* define a generally radially extending boss 38 having a pair of openings 40*a* and 40*b* (FIG. 1) formed therein which intersect the chamber 24 and receive a compressible fluid conduit or flow tube 42 therethrough so that the flow tube is looped about the rotor 28. The flow tube 42 is engaged by the compression rollers 30*a, b* and *c* so as to compress regions of the internal loop of the flow tube against a uniform diameter reaction surface 24*a* formed within the pump housing to extend about a substantial portion of the periphery of rotor 28. The flow tube 42 is conventional and is formed of a nonmetallic deformable material compatible with any fluid to be pumped and has a memory so that the tube will return to its original shape after being deformed by the compression rollers 30*a, b* and *c*. In operation, rotation of rotor 28 causes the compression rollers 30*a–c* to establish moving regions of compression along the stationary flow tube 42 and effect a peristaltic pumping action on fluid within the flow tube as is known. The center axis of the openings 40*a* and 40*b* in the housing 12 lie in the parting plane defined between the housing sections 12*a,b* to facilitate loading and removal or servicing of the flow tube 42 and/or the rotor 28 when the housing sections are separated.

In accordance with one feature of the present invention, the rotor 28 comprises a unitary member which is made from a nonmetallic material, such as a suitable plastic, having desired chemical resistance to any environment in which the pump 10 may be employed. The rotor 28 includes a pair of axially aligned hubs 46*a* and 46*b* which have annular bearing surfaces 48*a* and 48*b* journaled within cylindrical bearing surfaces 50*a* and 50*b*, respectively, formed within the respective housing sections 12*a* and 12*b* concentric with the bores 16*a* and 16*b*. A coating or lining of a solid lubricant such as Teflon, carbon, molybdenum disulphide and/or suitable silicones may be formed on the bearing surfaces 48*a,b* and 50*a,b* as separate liners or as additives to the plastic material from which the rotor and housing sections are made during forming thereof to reduce rotational friction during rotation of the rotor, thereby enabling optimum rotational speeds and loading of the rotor. In this manner, relatively expensive anti-friction ball, roller and needle type bearings as have heretofore been employed in rotatably supporting rotors within peristaltic pump housings are eliminated and significant cost reductions are realized.

Figure 3:
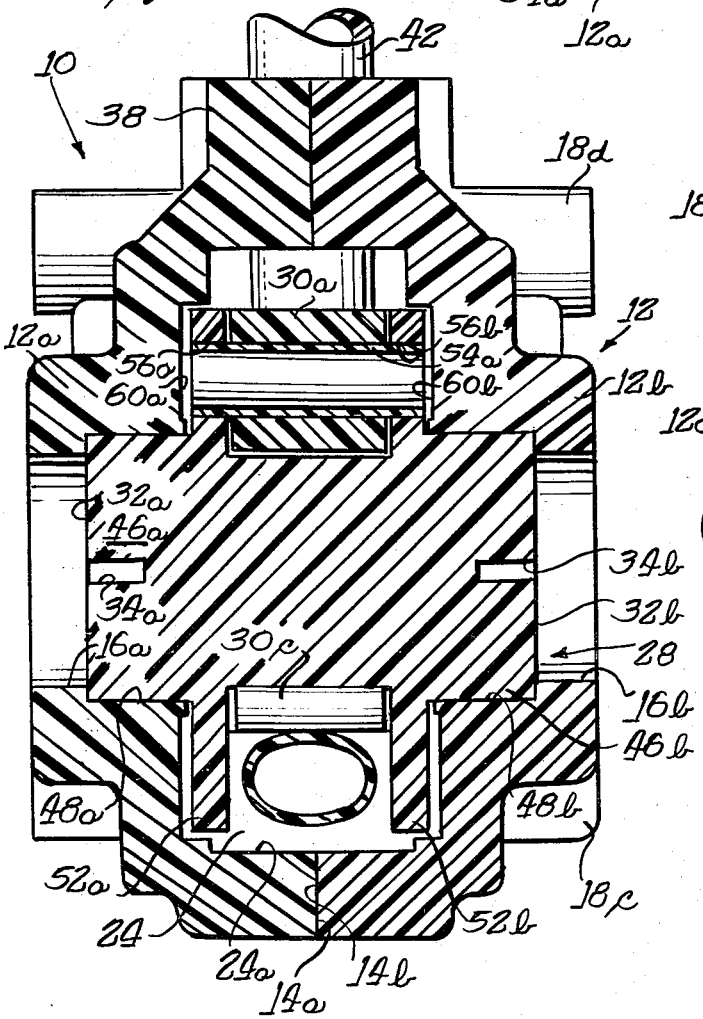
FIG. 3 is a longitudinal sectional view, on an enlarged scale, taken substantially along line 3—3 of FIG. 2, looking in the direction of the arrows.

In accordance with another feature of the present invention, the nometallic compression rollers 30*a, b* and *c* are supported by and between annular radial flanges 52*a* and 52*b* of the unitary rotor 28 through relatively thin walled, cylindrical, metallic tubular open ended shafts 54*a, b* and *c*. As best illustrated in FIG. 3, each of the tubular roller support shafts 54*a, b* and *c* has its opposite ends supported in fixed relation within suitable axially aligned bores 56*a* and 56*b* formed in the radial rotor flanges 52*a* and 52*b*, the three support shafts lying on a common diameter and being equidistantly circumferentially spaced about the axis of rotation of the rotor. Each roller 30*a, b* and *c* is mounted on its associated support shaft 54*a, b* and *c* so as to be freely rotatable thereon during rotation of the rotor 28, thus allowing free rotation of the pressure rollers as they ride along the surface of the compressible flow tube 42. The metallic tubular support shafts 54*a, b* and *c* are made of a metallic material having a relatively high heat transfer coefficient and suitable hardness and corrosion resistance to match the intended environment in which the pump will be employed, and have external surface finishes compatible with the corresponding pressure rollers 30*a, b* and *c*. One example of a suitable material for shafts 54*a, b* and *c* is stainless steel tubing. The pressure rollers 30*a–c* are preferably made of a plastic material such as Deblin and may have a solid lubricant either intermxied therewith or formed as a coating or liner on the inner cylindrical bearing surface of each roller, such solid lubricant being selected, for example, from the aforementioned Teflon, carbon, molybdenum disulphide and fluid silicone additives.

The internal chamber 24 within which the rotor 28 is received within housing 12 is defined in part by annular planar surfaces 60*a* and 60*b* (FIG. 3) lying in planes normal to the longitudinal axis of the housing. The flanges 52*a* and 52*b* of the rotor 28 are spaced inwardly from the annular wall surfaces 60*a* and 60*b*, respectively, so that the opposite ends of the tubular support shafts 54*a, b* and *c* are in open flow communications with the annular spacial areas between the rotor flanges and the housing wall surfaces 60*a,b*. In this manner, during operation of the pump 10 air or other fluid may pass through the roller support shafts 54*a, b* and *c* and effect transfer of heat created by the frictional rotation of the pressure rollers 30 on their support shafts. The radial wall thickness of the compression rollers 30 is preferably minimized so that any heat generated from rotation of the pressure rollers on their support shafts may also be transferred through the pressure rollers and the adjacent wall of flow tube 42 where the heat is transferred to and removed by the fluid flowing through the flow tube.

By mounting the pressure rollers 30*a, b* and *c* on relatively thin walled metallic tubular open ended support shaft 54*a–c* in a manner facilitating heat transfer as aforedescribed, anti-friction bearings as have heretofore been employed to rotatably mount pressure rollers on associated rotors in peristaltic pumps are eliminated with resulting significant reduction in manufacturing costs.

Thus, in accordance with the present invention, a peristaltic pump and associated rotor construction and pressure roller support arrangement is provided which results in a simplified construction and eliminates costly anti-friction bearings both between the hubs of the rotor and the pump housing, and between the various pressure rollers and their associated support shafts.

While a preferred embodiment of the present invention has been illustrated and described, it will be understood that changes and modifications may be made therein without departing from the invention and its broader aspects. Various features of the invention are defined in the following claims.

What is claimed is:

1. In a peristaltic pump which includes a housing having an internal chamber defined in part by a reaction surface, a rotor rotatably supported by said housing within said chamber, said rotor including a pair of longitudinally spaced radial flanges, and at least one compression surface supported by and between said flanges for rotation with said rotor, said rotor and reaction surface being cooperative upon rotation of said rotor to effect a peristaltic pumping action on a compressible fluid flow tube when disposed between said rotor and said reaction surface; the improvement wherein said compression surface is defined by a compression roller having a cylindrical longitudinal bore therethrough, and including a tubular cylindrical noncompressible support shaft received through said bore in direct supporting relation with said roller so as to enable rotation of said roller on said support shaft, said support shaft having a relatively high heat transfer coefficient and having open opposite ends fixedly received within axially aligned bores in said flanges so as to be supported by and between said flanges, said support shaft and said flanges establishing an open fluid flow passage through said support shaft so as to enable fluid flow therethrough to dissipate heat generated by rotation of said roller on said support shaft.

2. A peristaltic pump as defined in claim 1 wherein said radial flanges of said rotor comprise annular flanges.

3. A peristaltic pump as defined in claim 1 wherein said roller comprises a substantially cylindrical nonmetallic roller.

4. A peristaltic pump as defined in claim 1 wherein said tubular support shaft is metallic.

5. A peristaltic pump as defined in claim 1 including a plurality of said compression rollers carried by said rotor in substantially identical fashion, said compression rollers being supported in generally equidistantly circumferentially spaced relation about the axis of rotation of said rotor.

6. A peristaltic pump including a housing defining a longitudinal axis and having a pair of mutually cooperable housing sections defining a parting plane transverse to said longitudinal axis, said housing sections defining an internal chamber therebetween the outer periphery of which is established by a reaction surface, said housing being adapted to receive a compressible flow tube within said internal chamber, a rotor rotatably supported by said housing within said internal chamber and having a pair of axially spaced radial flanges thereon, at least one compression roller rotatably supported by and between said radial flanges for rotation therewith so as to effect a peristaltic pumping action on a compressible flow tube when disposed within said internal chamber between said reaction surface and said compression roller, said housing having a pair of axially aligned annular bearing surfaces formed thereon, said rotor comprising a unitary nonmetallic rotor member having integral axial rotor hubs defining annular bearing surfaces directly journaled within said annular bearing surfaces formed on said housing, said radial flanges defining at least one pair of axially aligned bores, and a tubular open ended cylindrical support shaft having opposite open ends fixedly supported within said axially aligned bores in said radial flanges so that said support shaft extends between said flanges and supports said compression roller for rotation thereon, said tubular support shaft having a relatively high heat transfer coefficient and having its internal passage in open fluid communication with said chamber within said housing to enable fluid flow therethrough to dissipate heat generated by rotation of said roller on said support shaft.

7. A peristaltic pump as defined in claim 6 wherein said rotor is made of a plastic material.

* * * * *